US005549455A

United States Patent [19]

Speer

[11] Patent Number: 5,549,455

[45] Date of Patent: Aug. 27, 1996

[54] THROUGH THE HUB EXHAUST FLOW IMPROVEMENTS FOR MARINE VARIABLE PITCH PROPELLER

[75] Inventor: Stephen R. Speer, Spokane, Wash.

[73] Assignee: Aerostar Marine Corporation, Spokane, Wash.

[21] Appl. No.: 375,001

[22] Filed: Jan. 18, 1995

Related U.S. Application Data

[63] Continuation of Ser. No. 150,271, Nov. 9, 1993, abandoned, which is a continuation of Ser. No. 913,835, Jul. 15, 1992, abandoned.

[51] Int. Cl.[6] ..... B63H 1/28

[52] U.S. Cl. ..... 416/93 A; 416/140

[58] Field of Search ..... 416/31, 33, 34, 416/38, 43, 93 A, 131, 139, 140, 135, 244 B, 204 R, 205, 231

[56] References Cited

U.S. PATENT DOCUMENTS

| | | | |
|---|---|---|---|
| 2,479,057 | 9/1949 | Bodger | 416/204 A |
| 2,528,609 | 11/1950 | Rouse | 416/131 |
| 2,608,257 | 9/1952 | Godfrey | 416/140 R |
| 3,477,796 | 11/1969 | Weiland | 416/204 |
| 3,604,819 | 9/1971 | Krahe | 416/204 |
| 4,118,143 | 10/1978 | Kavan | 416/31 |
| 4,212,586 | 7/1980 | Agular . | |
| 4,275,991 | 6/1981 | Söderbaum | 416/140 R |
| 4,802,872 | 2/1989 | Stanton | 416/93 A |
| 4,834,683 | 5/1989 | Govan | 416/93 A |
| 4,875,829 | 10/1989 | Van der Woude . | |
| 4,929,153 | 5/1990 | Speer . | |
| 4,973,225 | 11/1990 | Kruppa | 416/93 A |
| 4,984,967 | 1/1991 | Cruzen | 416/140 R |
| 5,032,057 | 7/1991 | Speer . | |
| 5,290,147 | 3/1994 | Karls et al. | 416/139 |

*Primary Examiner*—Edward K. Look
*Assistant Examiner*—Mark Sgantzos
*Attorney, Agent, or Firm*—Barry G. Magidoff

[57] ABSTRACT

This invention provides a variable pitch marine propeller which is replaceable onto the drive shaft of a marine engine and which provides an exhaust channel through the propeller. To improve and increase the flow of exhaust gas through the propeller the propeller is provided with a blade shank having a cross-sectional area perpendicular to the direction of exhaust gas flow which is less than the cross-sectional area parallel to such flow in the region of the shank arm attachment. There are also provided, within the interior of the propeller, internal surfaces formed within the blade arm adjacent the shank and defining at least one channel to allow exhaust gases to flow through the arm and counterweight assembly. In addition, the propeller is formed such that the connecting region between the blade arm and the counterweight on each blade has a reduced radial width, smaller than that of the counterweight mass along an axis parallel to the drive shaft axis and parallel to the flow of exhaust gases. In addition, each counterweight mass presses against, and is supported by, an inner surface of the hub case, when the blades are positioned at their maximum pitch position. This propeller further is provided with a secondary exhaust port opening through the hub case having a valve movably secured to the propeller so as to permit opening and closing of the secondary exhaust port; the valve is biased towards the closed position when the propeller is operating at low speed or is at rest. There are further provided cascading type inlet vanes, or blades, secured to the interior circumferential surface of the hub case and positioned in the exhaust gas flow path, wherein the maximum chord length of the inlet vanes or blades, is less than the radius of the hub outer case.

7 Claims, 18 Drawing Sheets

THROUGH THE HUB EXHAUST FLOW IMPROVEMENTS FOR MARINE VARIABLE PITCH PROPELLER

This is a continuation of application Ser. No. 08/150,271, filed on Nov. 9, 1993 which was a continuation of application Ser. No. 07/913,835, filed on Jul. 15, 1992 both of which are now abandoned.

This invention relates to variable pitch propeller hubs for outboard engines, wherein the open cross-section area is increased to provide lower exhaust pressure through the hub. More particularly, this invention relates to an improved geometry for the hub of a marine variable pitch propeller to provide for reduced exhaust pressure.

BACKGROUND OF THE INVENTION

The majority of pleasure boats currently utilize either outboard or stern drive propulsion systems that employ means to channel engine exhaust thru the propeller hub. See for example U.S. Pat. Nos. 4,875,829 and 4,802,872, for examples of constant pitch hubs having through the hub exhaust channels.

To improve the performance of these propulsion systems, designs have also been presented to provide means within the propeller hub to vary the pitch of the propeller blades, for example see U.S. Pat. Nos. 4,929,153 and 5,032,057. The mechanical components utilized in these variable pitch propellers generally result in a significant reduction in flow area available within the propeller hub that can be utilized for flow of the exhaust gases.

It is thus an object of the present invention to provide an increase in exhaust flow area. It is a further object of the present invention to provide a reduction in flow restriction while maintaining the variable pitch property and reducing engine exhaust back pressure.

In accordance with the present invention, a variable pitch marine propeller is provided having geometric arrangements that maintain the desirable low exhaust back pressure.

BRIEF DESCRIPTION OF THE DRAWINGS

A further understanding of the present invention can be obtained by reference to the preferred embodiments set forth in the illustrations of the accompanying drawings, which are intended to be only exemplary of the scope of this invention. Each drawing depicting the geometric arrangements of this invention is within itself drawn to scale, but different drawings may be drawn to different scales.

Referring to the drawings.

DETAILED DESCRIPTION OF THE INVENTION

Figure 1:
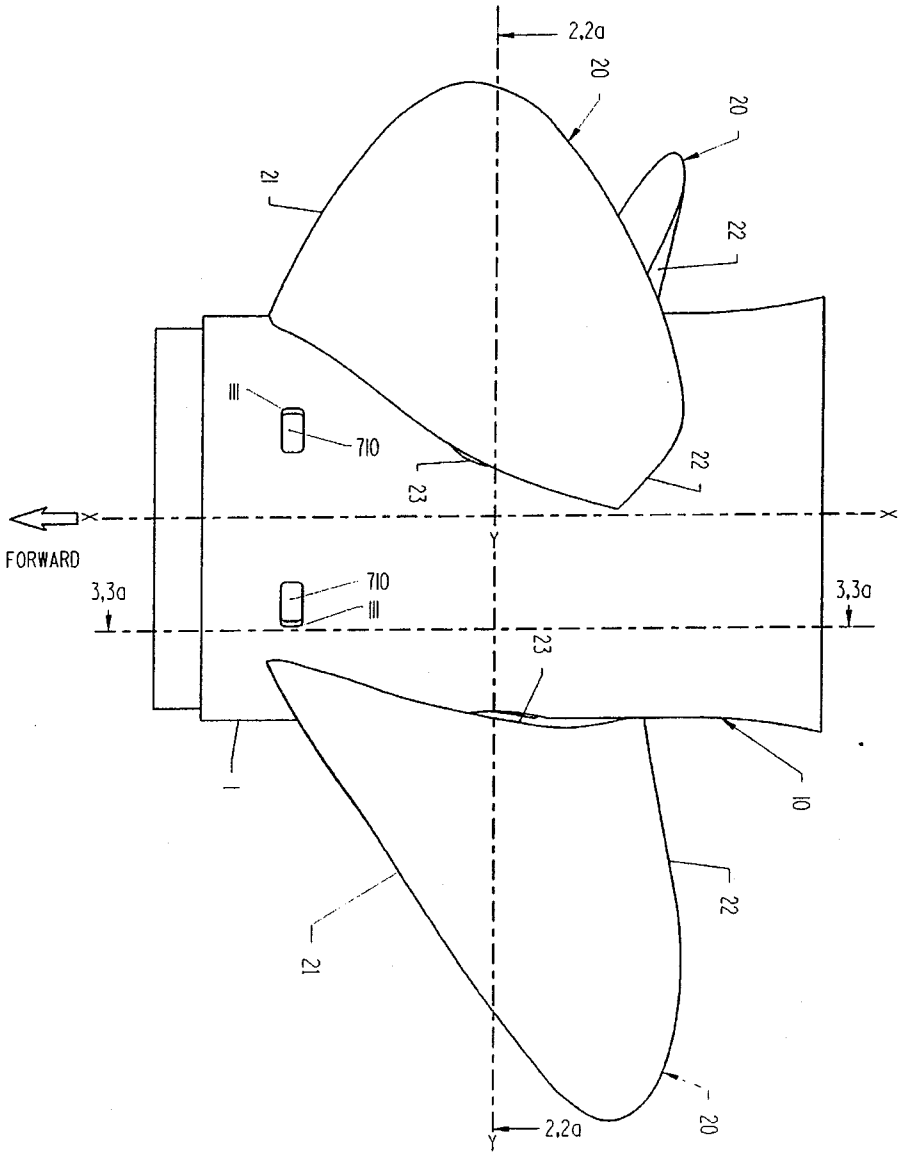
FIG. 1 shows a side view of a variable pitch marine propeller.

An external side view of a typical variable pitch marine propeller of this invention, is provided in FIG. 1. This view, shows a propeller hub 10 and three pivotable propeller blades 20. Each blade 20 has a leading edge 21, trailing edge 22 and pivot shank 23 positioned along a radial axis Y—Y. The propeller assembly is designed to be mounted to the drive shaft along axis X—X.

Figure 6:
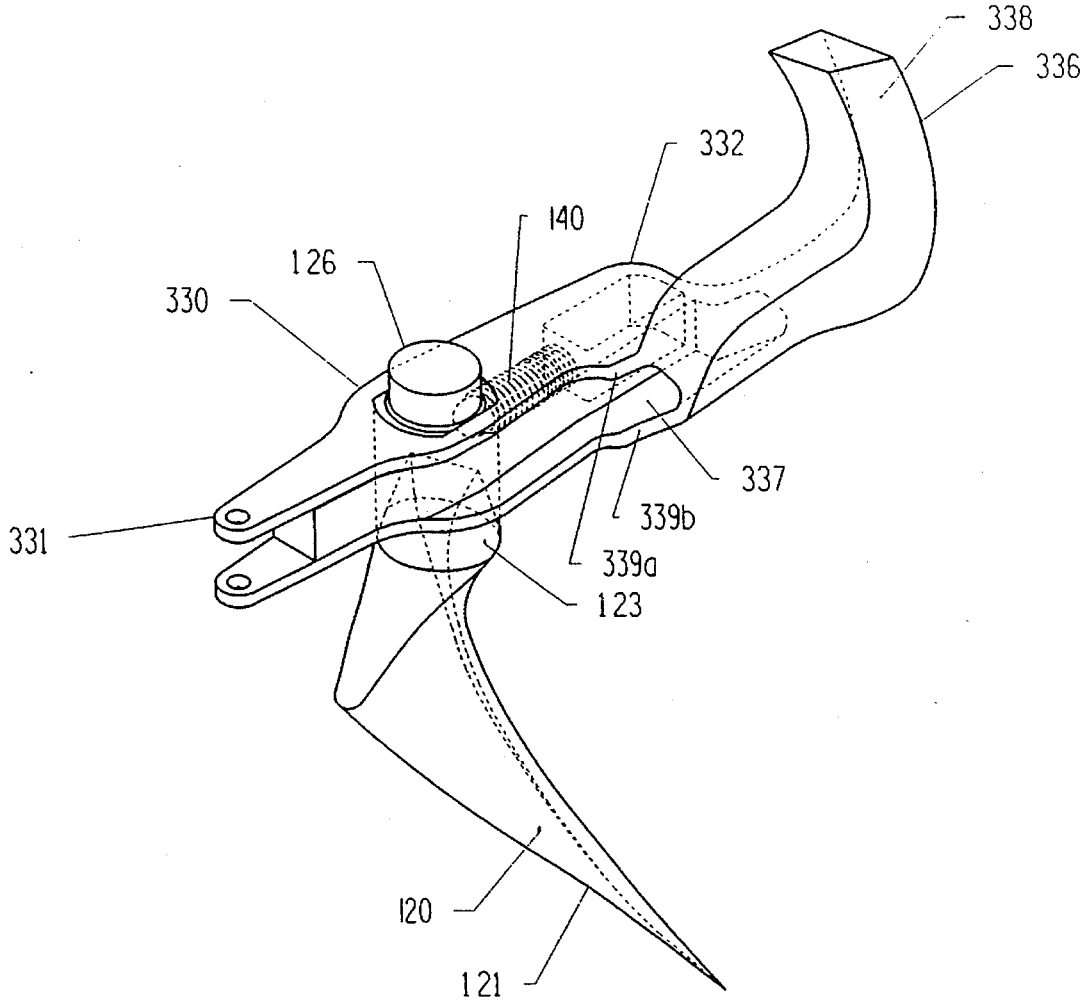
FIG. 6 shows an isometric view of a non-round shank/arm attachment configuration similar to FIG. 4, and having a counterweight mass and flow channel incorporated into the aft end of the arm in accordance with this invention.
Figure 7:
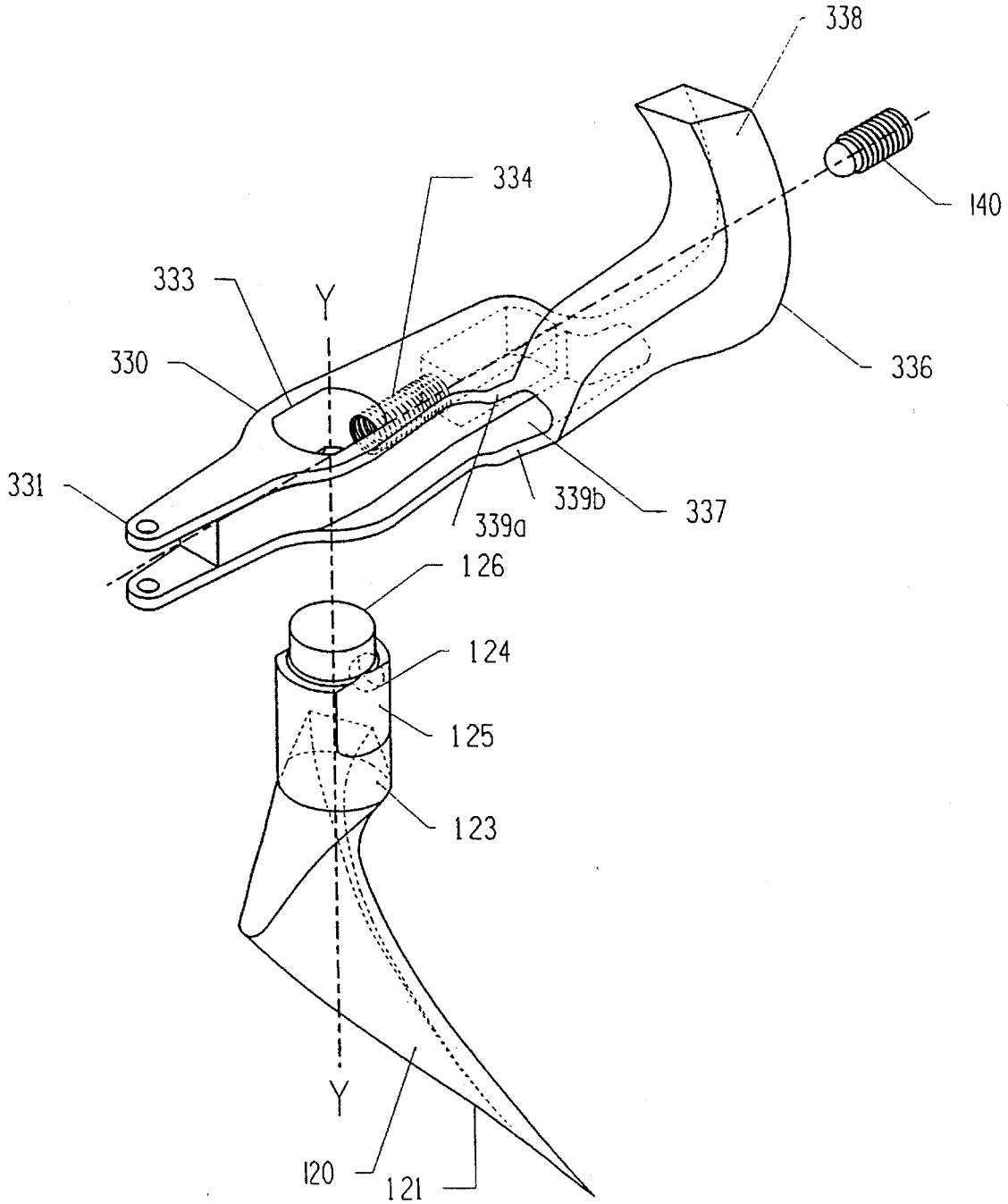
FIG. 7 is an exploded view of the components in FIG. 6.

The internal construction of a variable pitch marine propeller in accordance with this invention is shown in FIGS. 2 thru 5; FIGS. 2A and 3A depicting a propeller of the earlier patents by this applicant bearing fully rounded elements. The arrangement shown consists of three propeller blades 20,120, each having a shank 23,123 that is allowed to pivot within journal bearing 50 & 60,61 positioned along a radial axis YY within the hub 10. Internally within the hub 10 there is an arm 30,230 that is attached to the blade shank 23,123. The arm 30 may have one end 30,231 connected to a pitch position control or biasing device (not shown). Such pitch control or biasing devices may simply be a spring or may be a more sophisticated control mechanism as described in U.S. Pat. Nos. 4,929,153 and 5,032,057. Also, as shown in FIGS. 6 and 7, another embodiment of the arm 330 may incorporate a counterweight mass 336 at one end 332 to provide an inertial biasing torque as described in the above mentioned patents.

Figure 2:
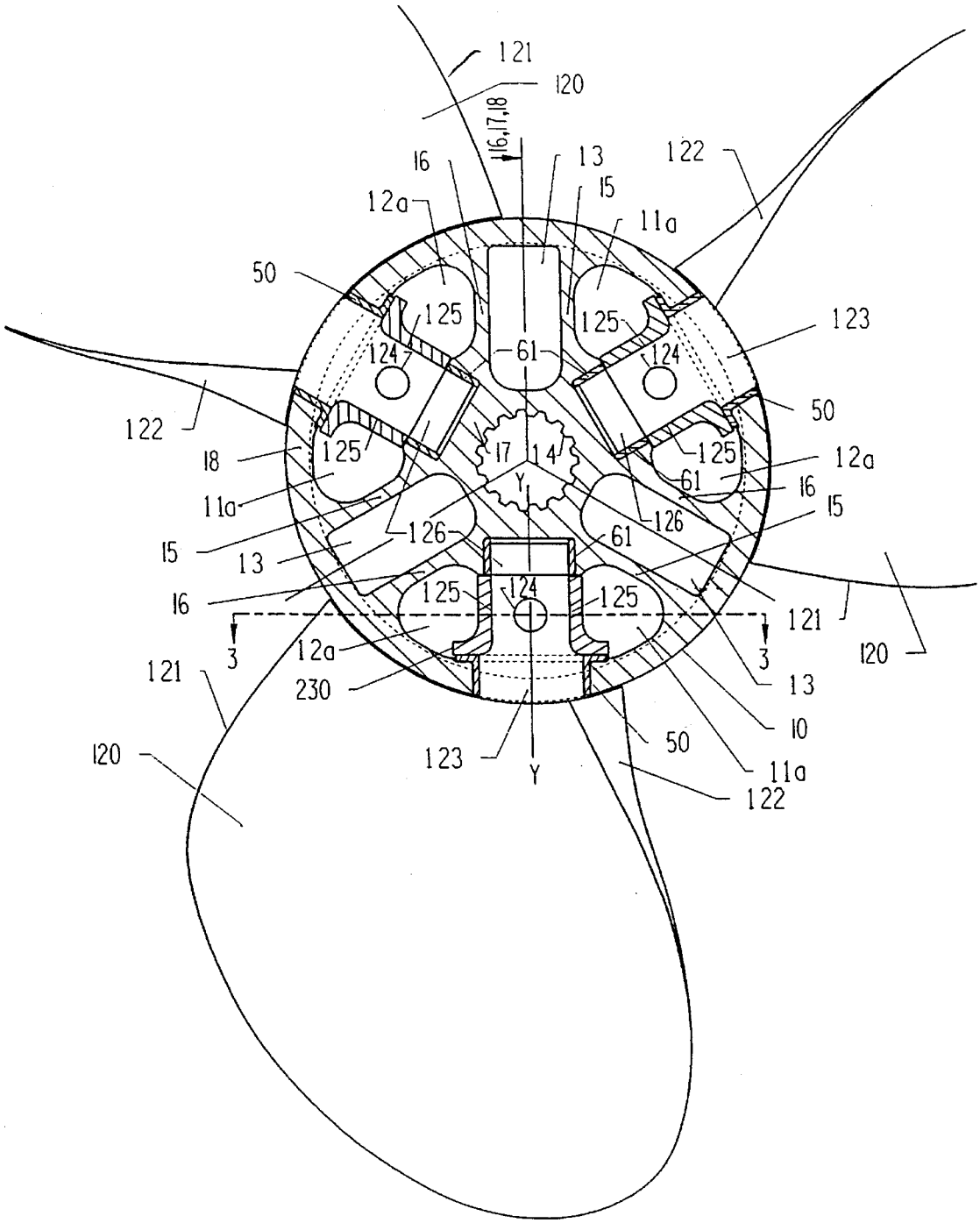
FIG. 2 is a forward looking cross-sectioned view taken along radial line 2—2 of FIG. 1 showing a hub and blade shank attachment geometry having a non-round configuration, in accordance with this invention.
Figure 2A:
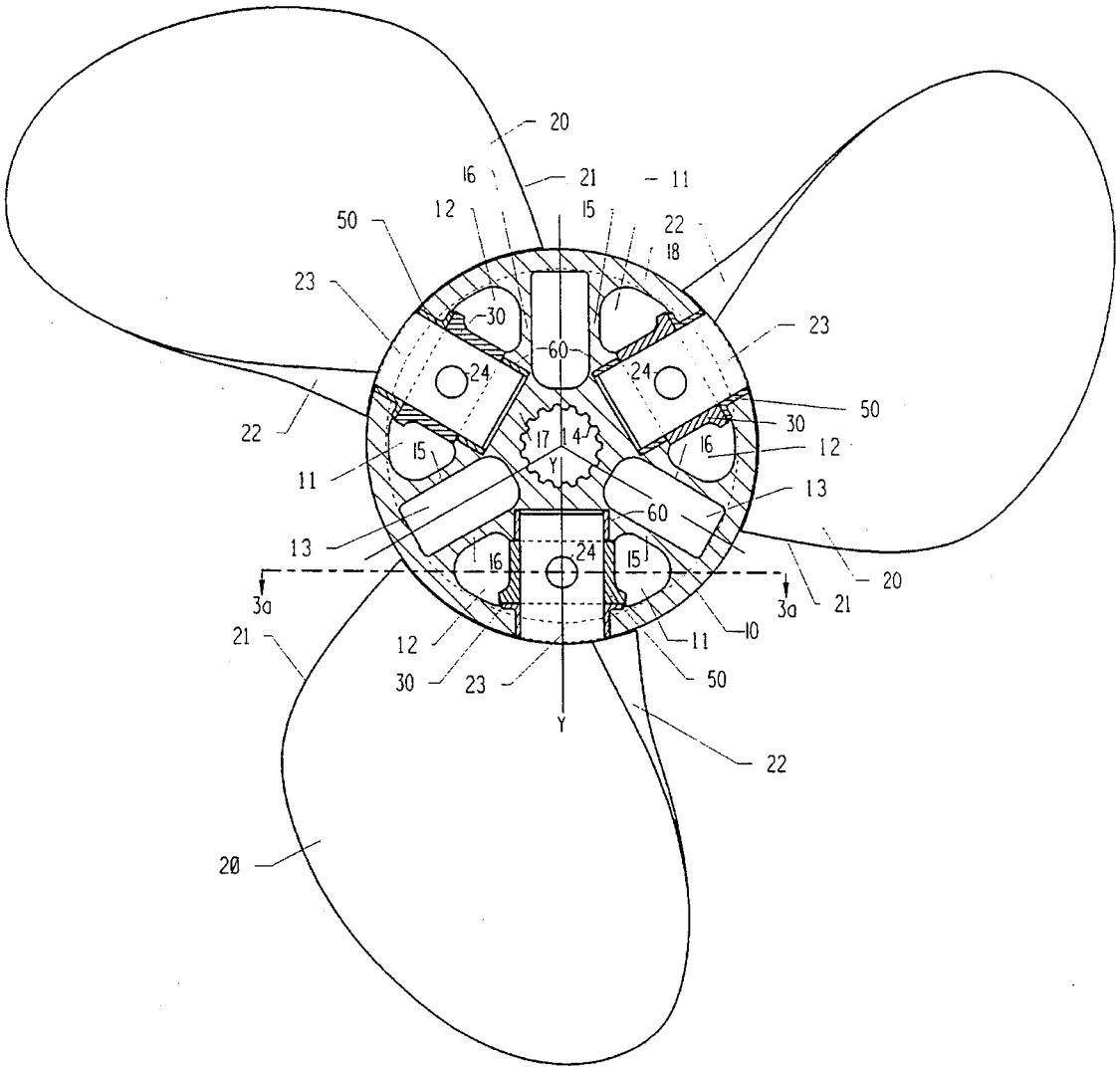
FIG. 2A is a forward looking cross-section view taken along radial line 2—2 of FIG. 1 showing a typical hub and blade shank attachment geometry of a conventional round shank configuration.
Figure 3:
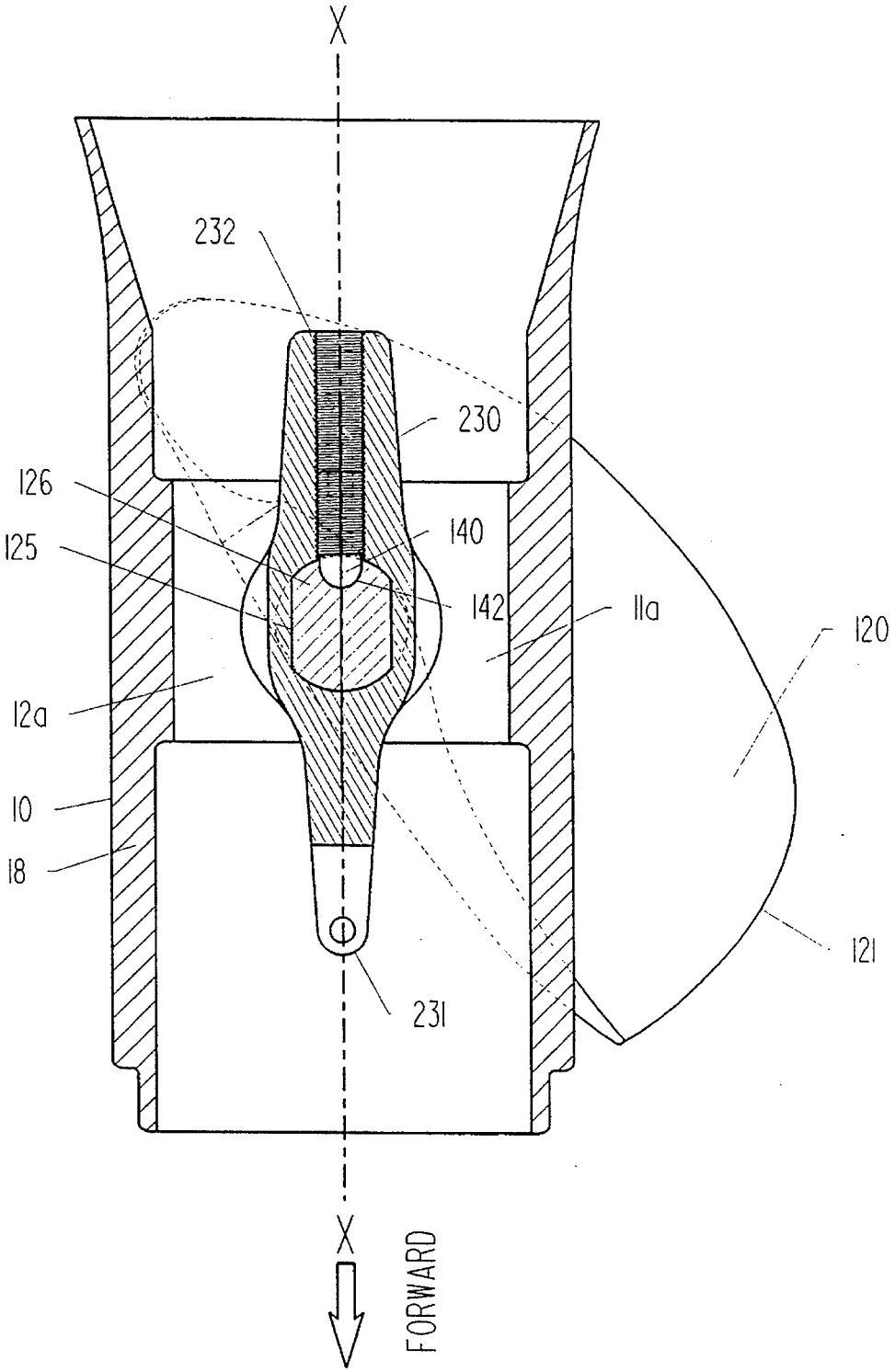
FIG. 3 is a cross-section view taken along a plane 3—3 of FIG. 2, parallel with the drive shaft axis X—X and perpendicular to a blade shaft axis Y.
Figure 3A:
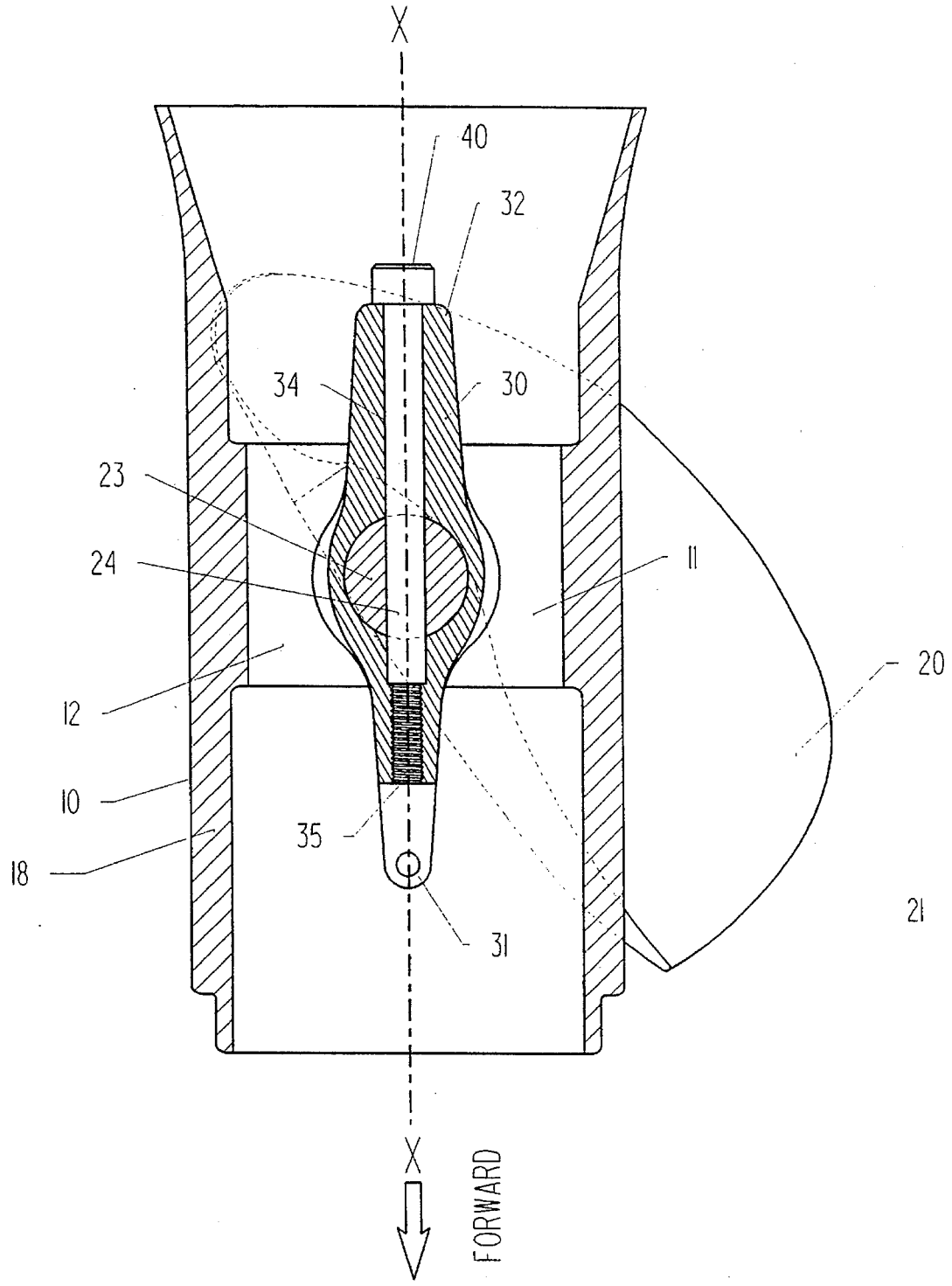
FIG. 3A is a cross-section view taken along a plane 3—3 of FIG. 2A, parallel with the drive shaft axis X—X and perpendicular to a blade shaft axis Y.
Figure 4:
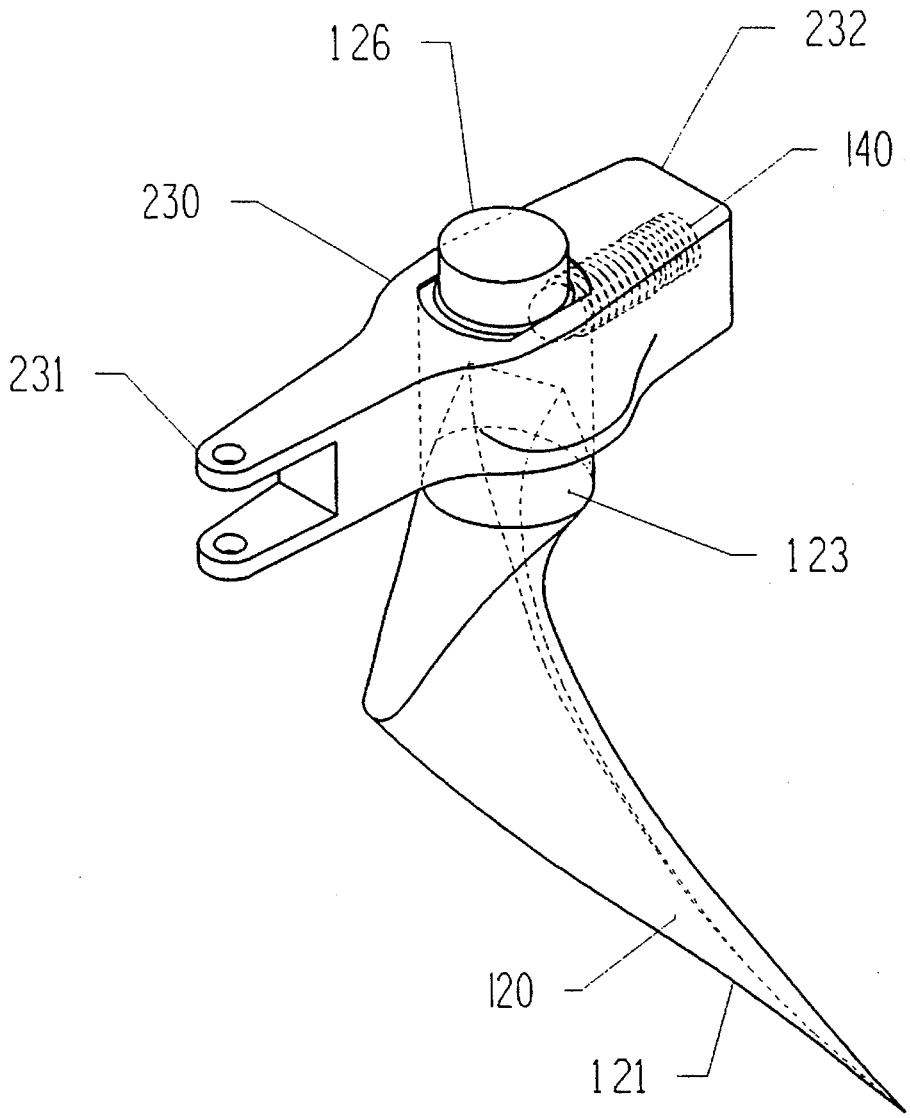
FIG. 4 shows an isometric view of a non-round shank/arm attachment configuration having flat surfaces and reduced axially projected assembly area in accordance with this invention.
Figure 5:
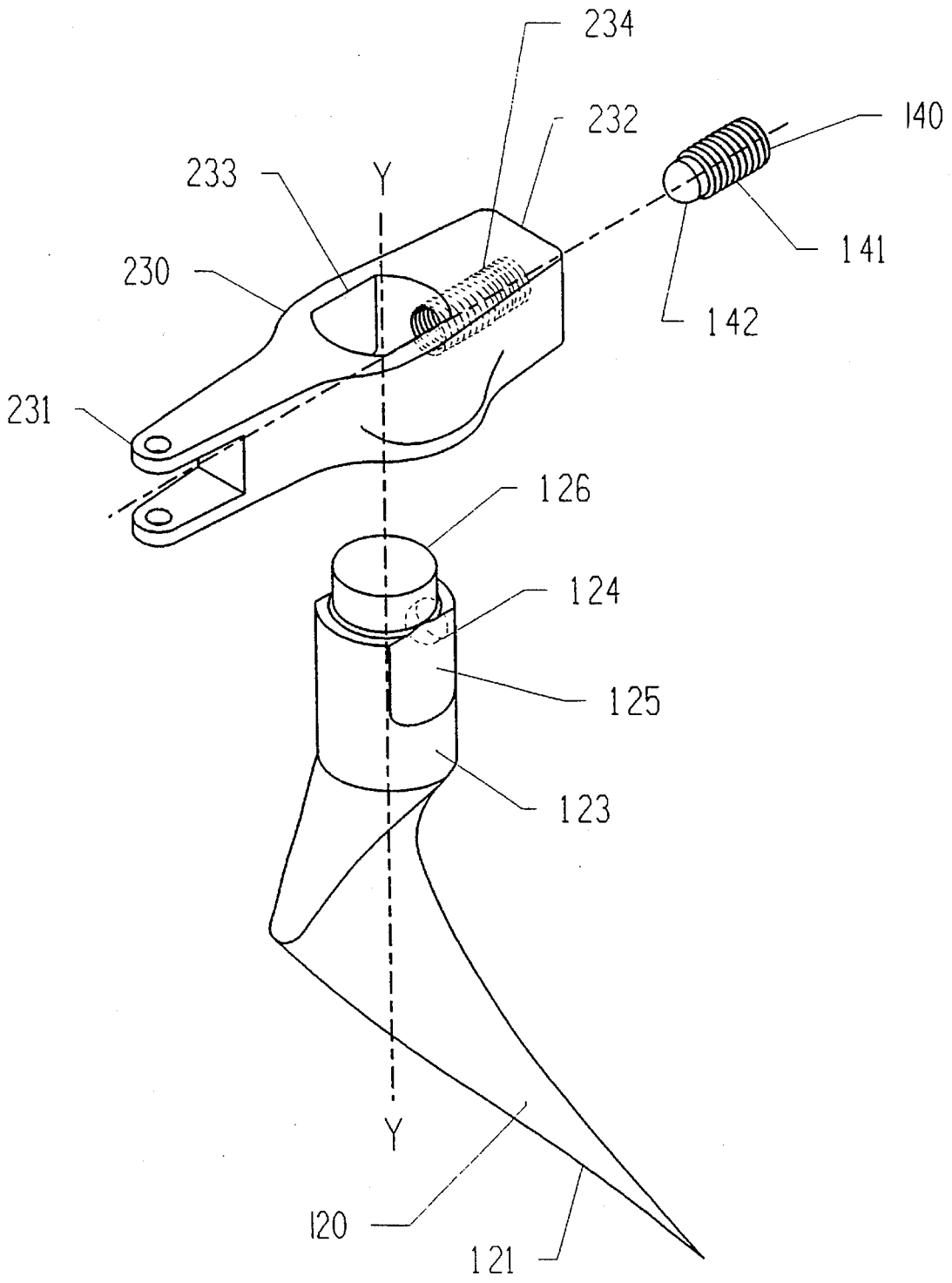
FIG. 5 is an exploded view of the components in FIG. 4.

The internal arrangement of the hub 10 provided in FIGS. 2 and 2A shows additional cavities 13 for mechanism control or actuating components. The hub 10 is composed of an outer case 18 connected to an inner hub 17 via spokes 15,16. Also shown are drive splines 14, and primary engine exhaust passages 11, 11*a* and 12,12*a* located on each side of the blade arm 30,230.

A conventional attachment geometry between the blade shank 23 and arm 30 is shown in FIGS. 2A and 3A. According to this arrangement, a round hole is provided in the arm 30 into which the blade shank 23 is inserted. A rigid connection between the arm 30 and blade shank 23 is accomplished by inserting the bolt 40 thru threaded hole 34 at one end of the arm 30, inserting the end of bolt 40 into hole 35 at the opposite end of arm 30, then tightening the bolt 40.

As shown in FIG. 2A, the blade shank 23 and arm 30 installation within the hub 10 results in a significant reduction in the flow area of the exhaust passages 11 and 12. To provide for an increase in flow area and a reduction in engine exhaust back pressure, a reduced profile attachment geometry is shown in FIGS. 2, 3, 4 and 5. This is accomplished by providing a non-round hole 233 in the arm 230, while the mating blade shank 123 has flat regions 125 such that the cross-sectional areas of the blade shanks 123 and the arm 230 assemblies as defined by a plane perpendicular to the blade shank axis Y and to the flow direction of the exhaust gas, are each reduced from that of a completely round arm hole 33 and shank 23, geometry, see FIG. 3. The arm 230 shown in FIGS. 2 and 4 also has provisions for a connection to some actuating or control mechanism which is provided at the forward end 231 of the actuating arm 230.

Figure 8:
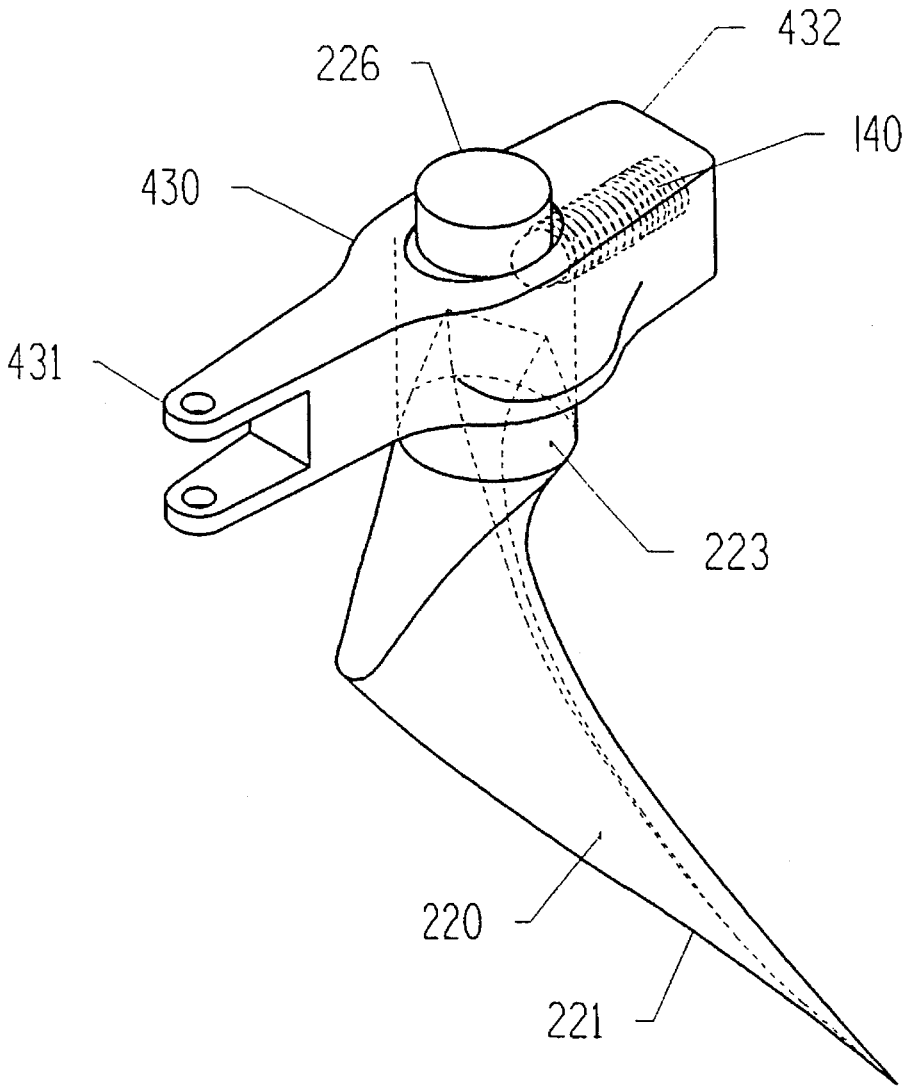
FIG. 8 shows an isometric view of a general non-round shank/arm attachment configuration having reduced axially projected assembly area.
Figure 9:
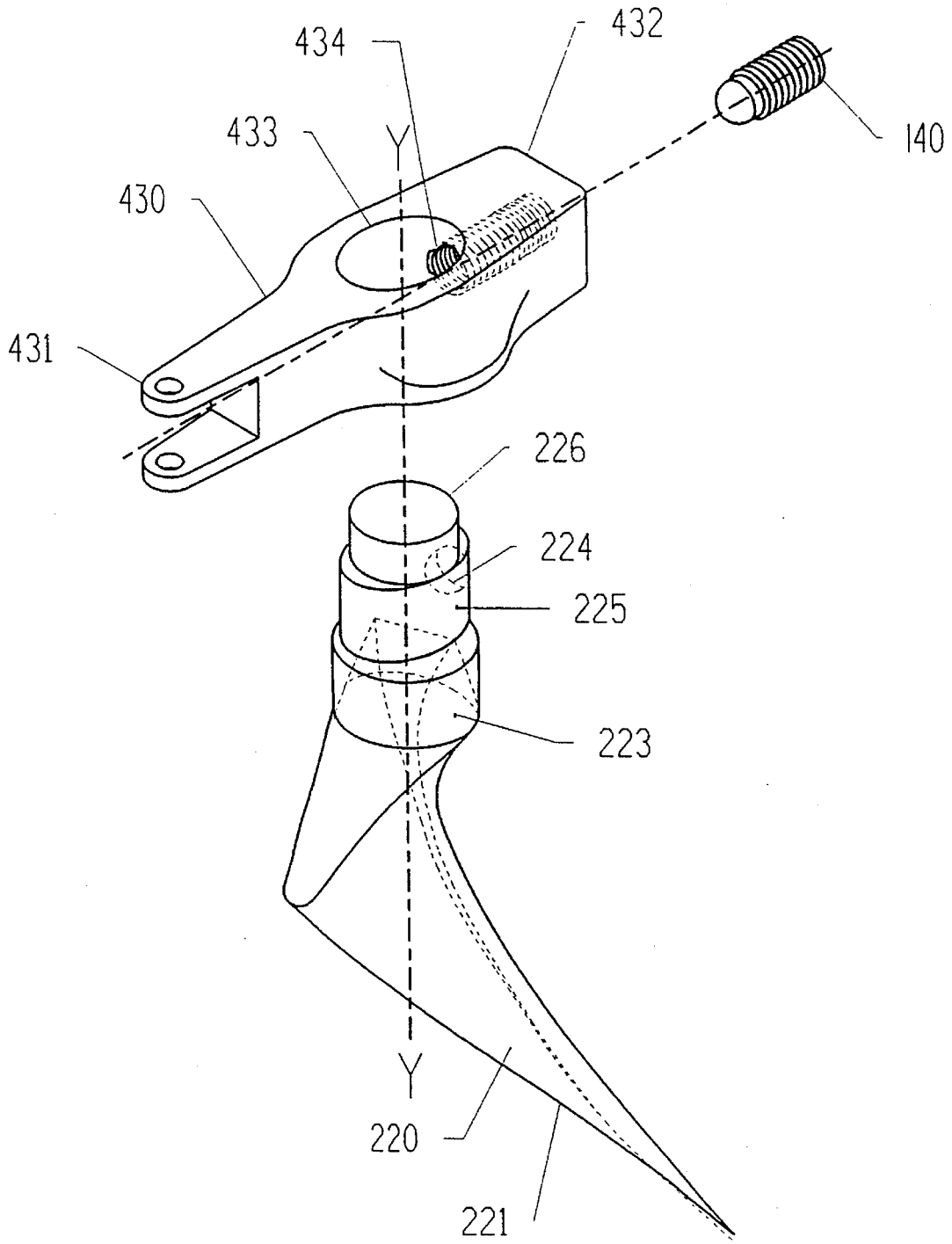
FIG. 9 is an exploded view of the components in FIG. 8.

The arrangements shown in FIGS. 2 thru 5 show a partially round shank with flat regions, 125; however, the equivalent relationship can be accomplished with any non-round shank section. For example, FIGS. 8 and 9 show an arrangement wherein the shank width is reduced to provide additional exhaust flow area within the confines of the propeller hub, by the use of an elliptical cross-sectional shape 225 for the portion of the shank 223 in the region of the attachment to the blade arm 430, where the major axis of the ellipse is parallel to the direction of exhaust gas flow. The blade arm 430 also includes an internal surface which defines a mating elliptically shaped hole 433. At the radially inward end of the blade shank 123 is a reduced cylindrical bearing shaft 226 that engages the inner hub bearing 61.

Due to the reduction in shank cross-sectional area associated with the reduced profile attachment geometry (FIGS. 2 through 9), the net strength of the blade shank to carry the hydrodynamic and inertial load imposed would be significantly reduced if the thru bolt attachment means shown for the round shank geometry (FIG. 2A) were used. A better means of attachment, shown in FIGS. 3 through 5; utilizes a mating blind shank cavity (124 in FIG. 5, 224, in FIG. 9), machined into the shank (123 in FIGS. 3–5, 223 in FIGS. 8 and 9). The preferred cavity geometry consists of a cylindrical wall with a hemispherical end. A set screw 140, having a male cylindrical extension 141 and hemispherical end 142, is inserted into threads (234 in FIG. 5, 334 in FIG. 7, 434 in FIG. 9) at the aft end (232 in FIGS. 4 and 332 in FIGS. 6 and 7, 432 in FIGS. 8 and 9) of the arm and the screw 140 is tightened until the male extension of the set screw completely engages and is seated into the mating shank cavity (124 in FIGS. 3–7, 224 in FIGS. 8 and 9).

As described in my earlier U.S. Pat. Nos. 4,929,153 and 5,032,057, it is sometimes desirable to incorporate a counterweight mass into the design of the blade arm to provide an inertial biasing torque about the blade shank. A typical arm 330 incorporating a counterweight 336 at the arm's aft end 332 is shown in FIGS. 6 and 7. This configuration, to facilitate the flow of exhaust gas, includes an improved actuating arm 330 design having a fluid flow channel 337 defined by two support members 339*a* and 339*b* incorporated into the arm's aft end 332. The arm geometry shown also incorporates a non-round hole 333 similar to that shown in FIGS. 4 and 5. A provision for connection to an actuating control mechanism is also provided on the forward end 331 of the actuating arm 330.

Figure 12:
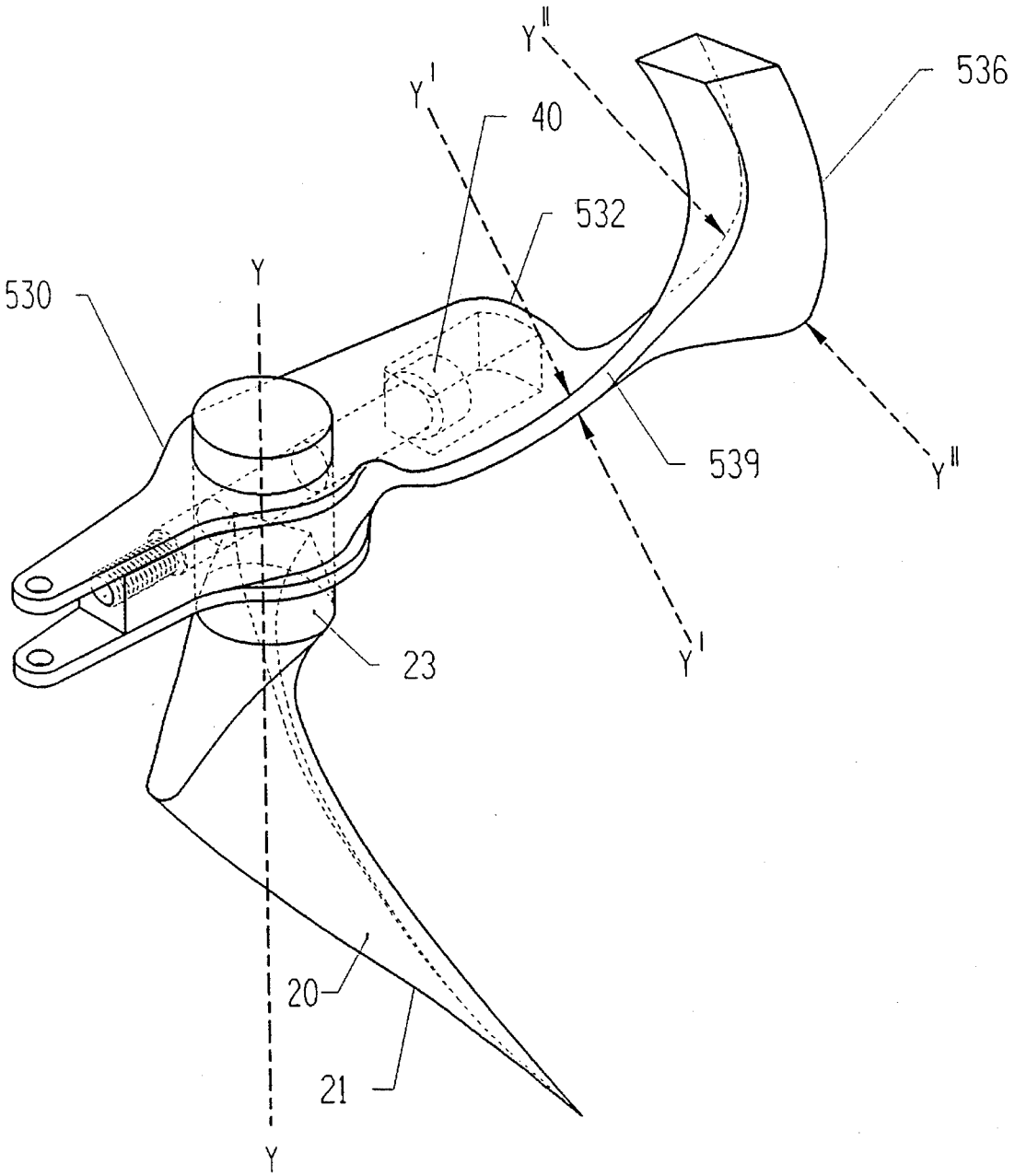
FIG. 12 shows an isometric view of a round shank/arm attachment configuration assembly with a counterweight similar to FIG. 6 but with a narrower connecting region between the arm and counterweight mass.

Alternatively, as shown in FIG. 12, the connection region between the arm 530 and counterweight mass 536 can have a narrower radial width (along radial line Y'—Y') or projection relative to the counterweight's maximum radial width (along radial line Y"—Y"). This narrower connection region 539 between the arm 530 and counterweight mass 536 results in a lesser restriction through the hub, and thus lower exhaust gas flow pressure loss.

The incorporation of the exhaust flow channel 337 in the blade arm 330 shown in FIGS. 6 and 7, or the narrower connection shown in FIG. 12, may reduce the strength and/or stiffness of the connection between the counterweight 336 and the blade arm 330. To help support the counterweight 336 during high pitch generally high speed operation, the counterweight outer surface 338 is arranged so that it comes in contact with the inner surface of the propeller hub when the propeller blades 20 are positioned at their maximum angle of pitch.

Figure 10:
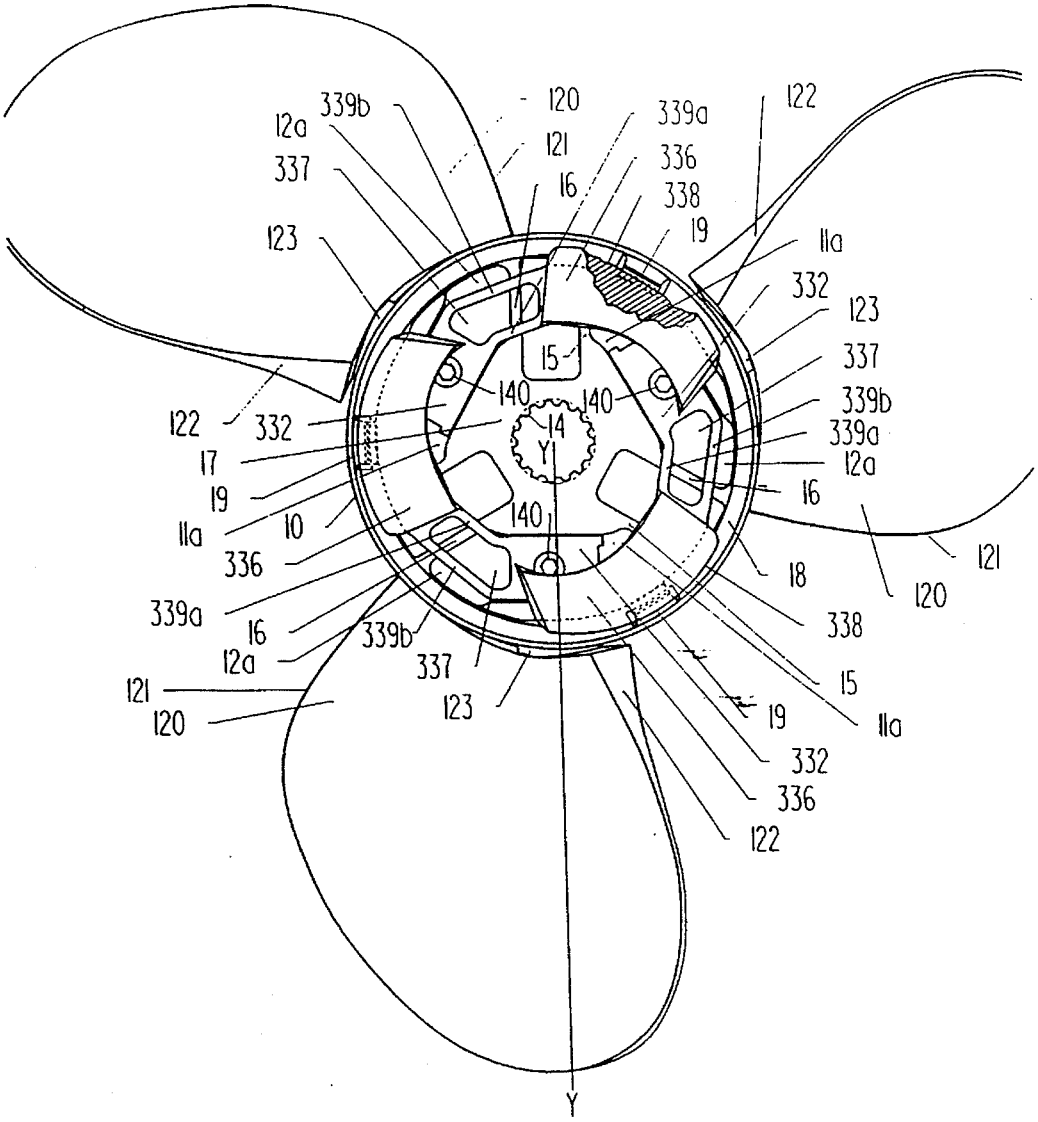
FIG. 10 is an aft view of the propeller assembly shown in FIG. 2.
Figure 11:
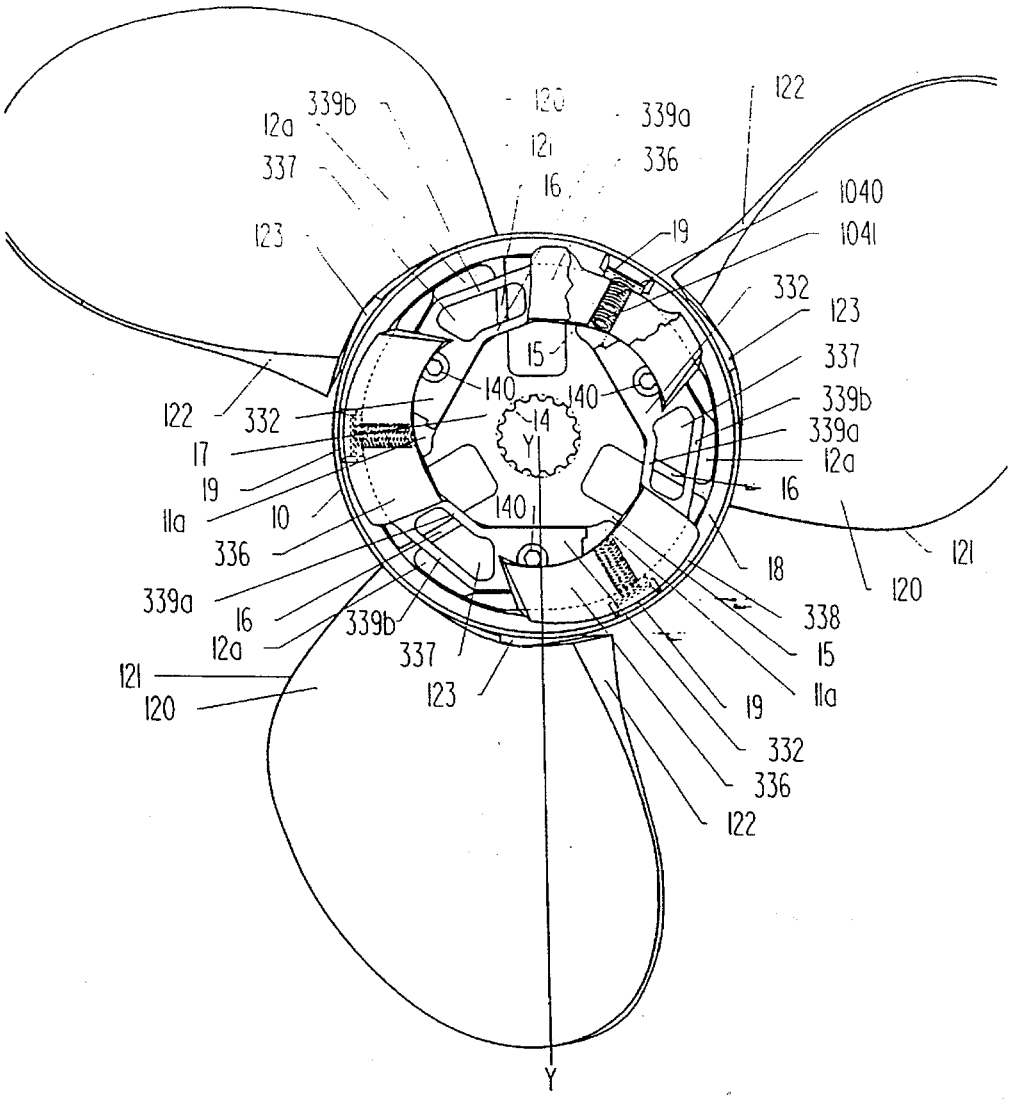
FIG. 11 is an alternate configuration of the assembly shown in FIG. 10.

As shown in FIG. 10, support pads 19 can be provided on the interior of the hub 10 such that the counterweight 336 outer surface 338 contacts the inner surface of the support pad 19 during operation. These pads can be adjusted as to their distance from the hub interior surface. Alternatively, FIG. 11 shows an adjustable high pitch stop means incorporated into the counterweight 336. This arrangement consists of a high pitch stop adjusting screw 1040 engaged in a threaded hole within the counterweight 336. In the preferred embodiment, the axis of the screw 1040 is positioned substantially perpendicular to the blade shank axis Y—Y. A lock screw 1041 may also be utilized to lock the adjustment screw 1040 into position.

As mentioned, the blade shank and arm installation within the hub can significantly reduce the available exhaust gas flow area. Another approach is to provide secondary exhaust flow ports through the outer hub case 10, upstream of the blade shank region. The incorporation of secondary exhaust flow ports into the hub is commonly used, for fixed pitch marine propellers. However, the application of these secondary exhaust ports is primarily for improving engine rpm response by injecting the exhaust gases into the water flow region of the hub in such a manner that during initial acceleration, a portion of each blade has increased flow separation. This increased flow separation partially unloads the propeller allowing the engine speed (rpm) to increase at a faster rate.

The prior design practice is to provide one exhaust port hole for each blade, with the hole located at the forward end of the propeller hub, near the blade leading edge, and suction surface. Some designs have also been presented, for example U.S. Pat. No. 4,802,872, that provides means to close these secondary exhaust ports after a desired engine rpm has been achieved.

The application of secondary exhaust ports in the hub of a marine variable pitch propeller generally involves different objectives and operation. Since the propeller blade can initially be positioned at a lower angle of pitch, sufficient engine rpm required to develop desired power can be easily obtained. Thus there is no need to employ the secondary exhaust gas flow as a means to unload the propeller during acceleration. In fact, flow of exhaust gases out the secondary ports in the hub can adversely effect the acceleration performance of variable pitch propeller blades. This is because the higher hydrodynamic loading on the blades when at a lower angle of pitch and high power acceleration, can cause the blades to be more susceptible to severe flow separation or blow out. Thus a small flow of exhaust gas out the forward end of the hub may cause severe flow separation or blow out and thus adversely affect the acceleration performance of a variable pitch marine propeller.

Figure 13:
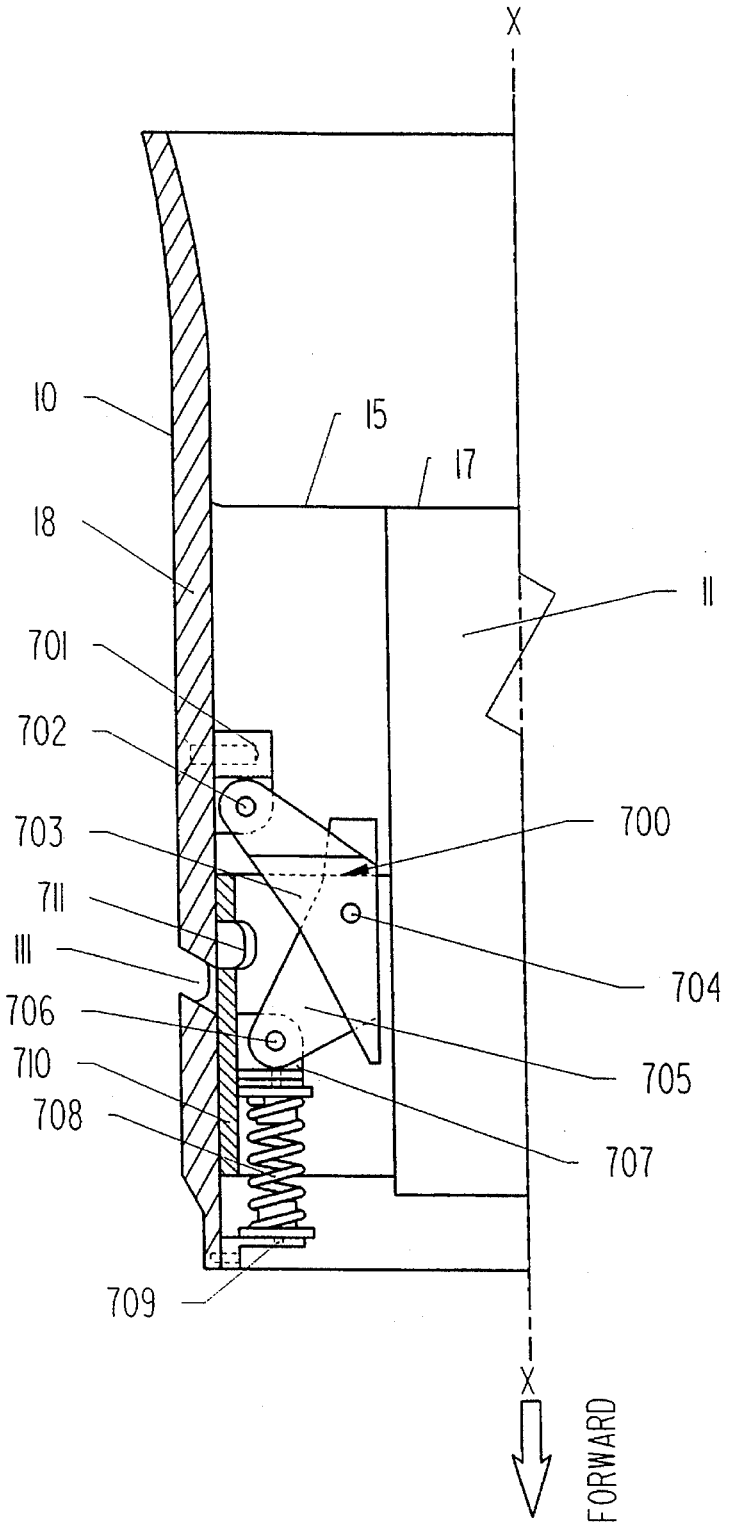
FIG. 13 shows a partial longitudinal section view of a propeller having a centrifugally actuated, spring return exhaust flow sleeve valve with the valve and mechanism shown in the closed position.
Figure 14:
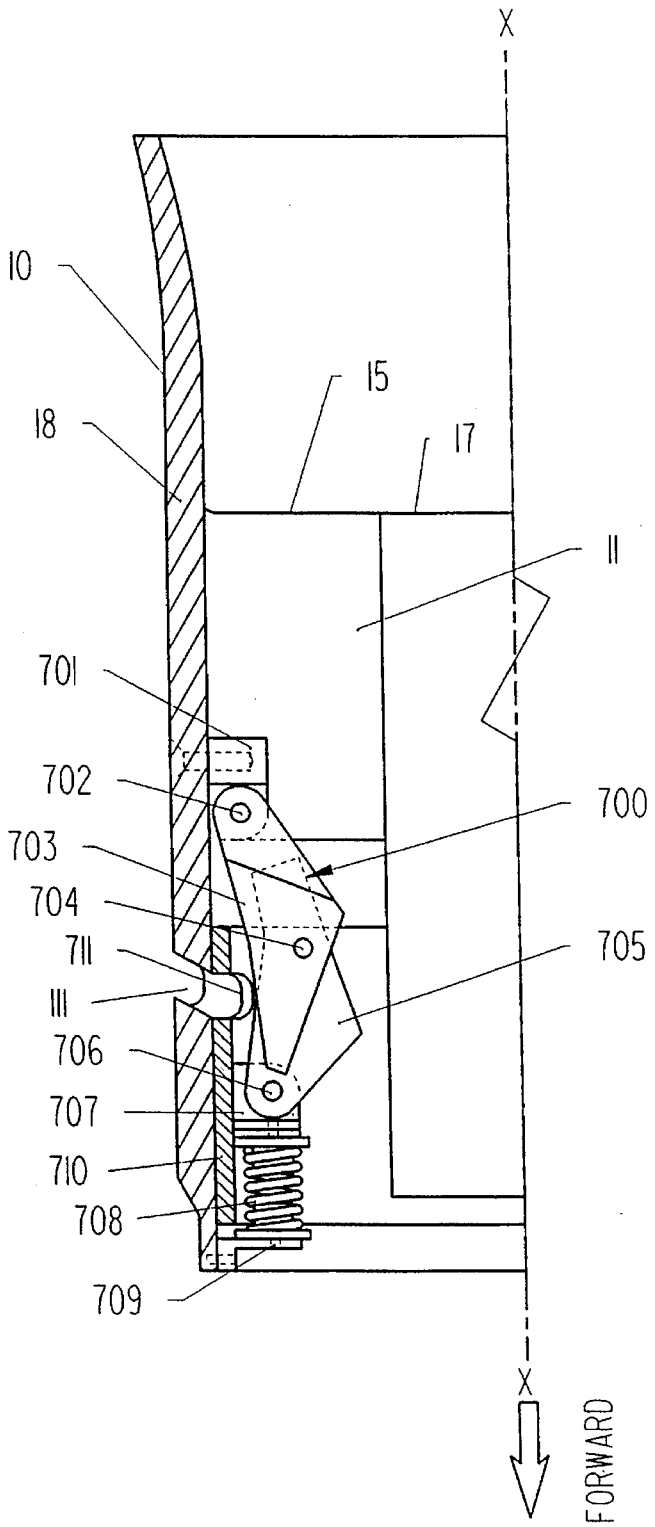
FIG. 14 shows the sleeve valve mechanism of FIG. 13 in the open position.

To obtain a solution that will allow lower engine exhaust back pressure during high speed cruise, yet not adversely affect the acceleration performance of a variable pitch marine propeller, means are provided herein, wherein an exhaust flow valve device is used to control the flow of the exhaust gases out of the secondary exhaust ports. The objective is to substantially close off the flow of the exhaust gases during the initial acceleration of the engine and boat, then begin to open these secondary exhaust ports after a desired engine or propeller rotational speed rpm has been achieved. An example of a control valve arrangement is shown in FIGS. 13 and 14.

These two drawings show a secondary exhaust port 111 provided in the forward region of the outer case of the hub 10 in combination with a primary exhaust channel 11 which allows engine exhaust to exit at the aft end of the hub. A centrifugally actuated mechanism generally indicated by the number 700 is provided which is used to move a cylindrical sleeve 710. Positioned in sleeve 710 are exhaust ports 711. When the propeller is at rest or at a low rotational speed, the return spring 708, having one end pushing against anchor 709 rigidly attached to hub 15 and the other end pushing against anchor lug 701 attached to sleeve 710, positions the sleeve 710 and mechanism assembly 700 in the position shown in FIG. 13. In this figure, the sleeve exhaust port 711 is positioned aft of the hub secondary port 111, thus substantially closing off any additional exhaust flow out of the hub secondary exhaust port 111.

A mechanism 700 is provided consisting of anchor 701 rigidly attached to the hub 10, weighted link 703 which is pivotally attached to the anchor 701 via pin 702 and pivotally attached to a second weighted link 705 via pin 704; and link 705 is connected to sleeve anchor 707 via pin 706. As the propeller rpm is increased, the centrifugal forces acting on the mass of the two weighted links 703 and 705 will generate a resultant force opposing the return spring 708. Once a desired minimum propeller speed has been attained, the resultant force imposed on the spring arising from the centrifugal forces on the weighted links 703 and 705 reaches a sufficient magnitude to overcome the spring's initial pre load, and the sleeve 710 begins to move forward. As the sleeve 710 moves forward, sleeve port 711 is placed over hub port 111 allowing exhaust gas to flow from inside the hub case 18 and out through ports 711 and 111, exiting out of the forward region of the hub outer case 10. Once the desired rpm has been attained, for example that used for normal cruising, the sleeve valve mechanism is positioned in the full open position shown in FIG. 14.

Figure 15:
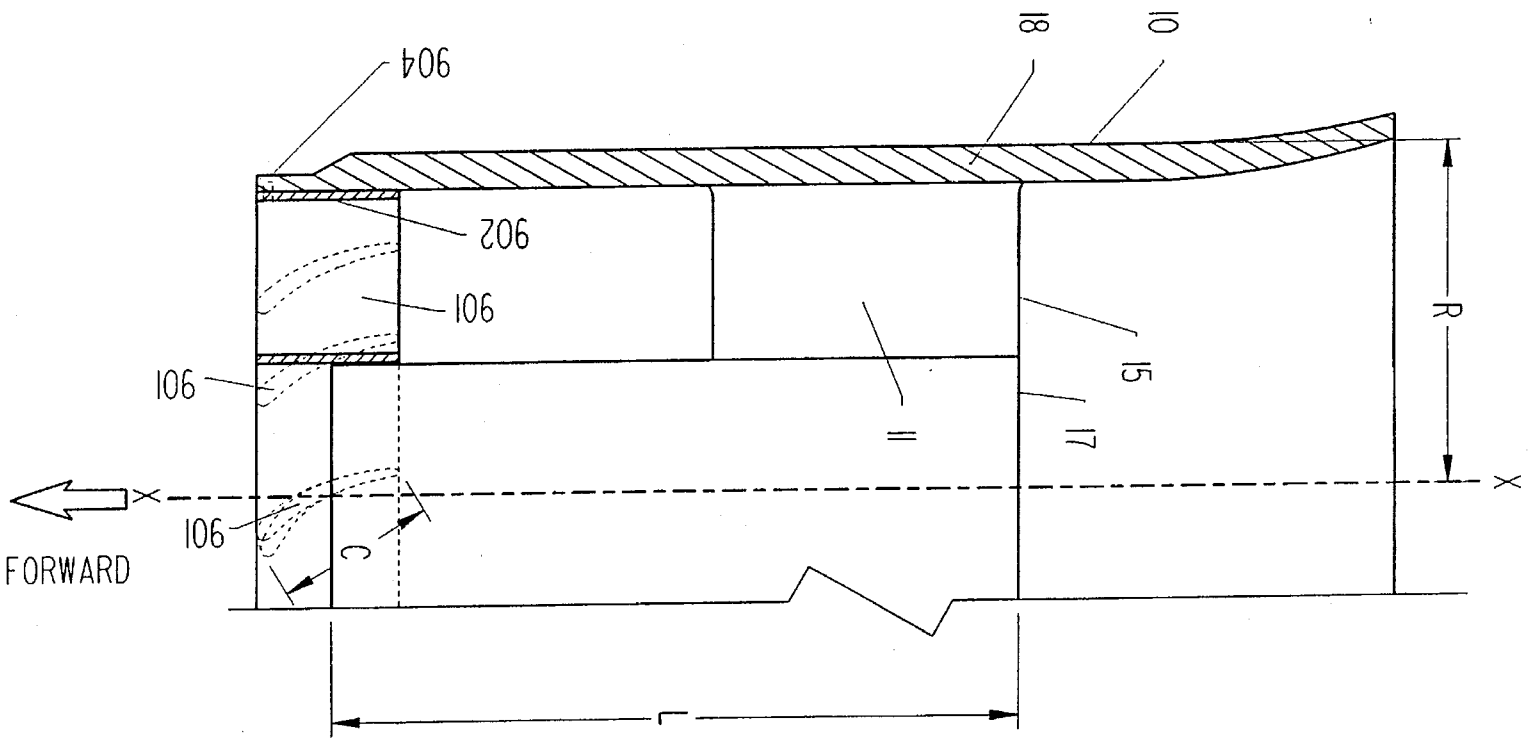
FIG. 15 shows a partial longitudinal view of a propeller having cascade flow vanes in the forward region of the propeller hub.
Figure 16:
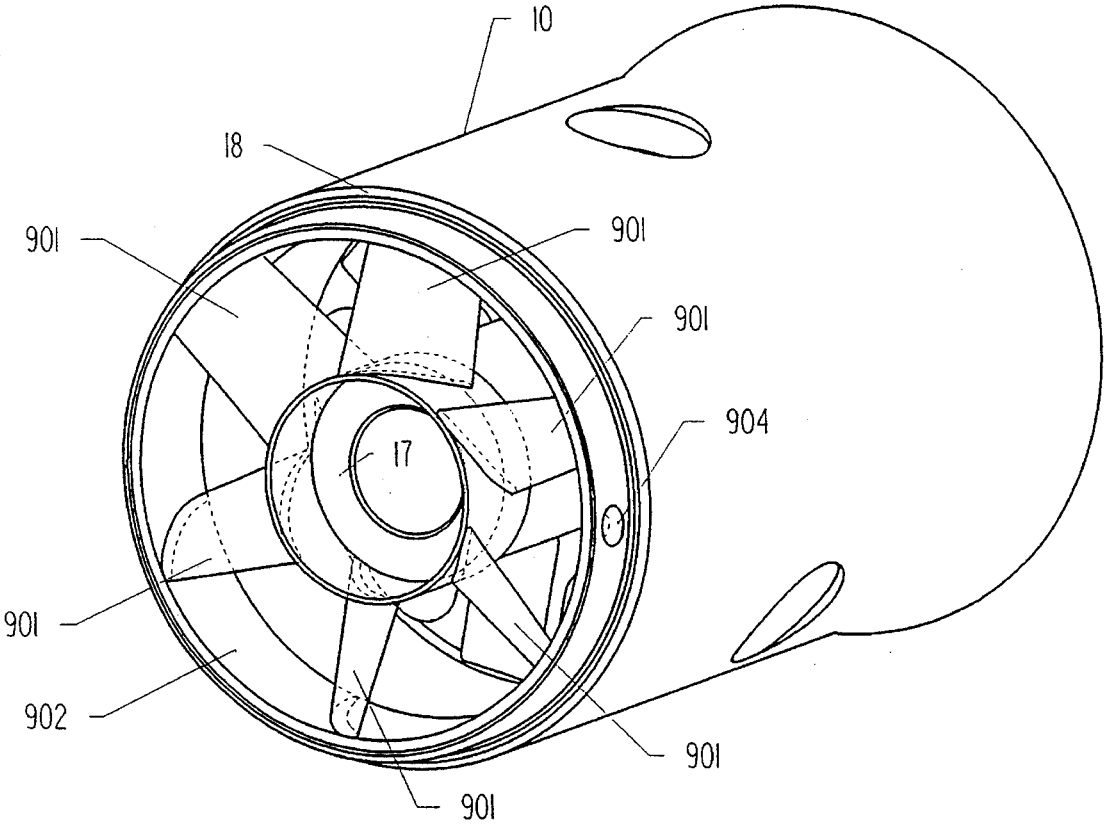
FIG. 16 is an isometric of the forward end of the propeller of FIG. 15, showing the cascade flow vanes.

Another improvement to enhance the flow of engine exhaust gas through the hub interior can be provided by placing a ring of cascade type flow vanes (or blades) at the forward end of the propeller hub interior. Such an arrangement is shown in FIG. 15. The configuration shown consists of hub 10 having an outer case 18 connected to an inner hub region 17 via spokes 15, which define a primary exhaust channel 11. Positioned at the forward end of the hub 10 is a ring 902, rigidly attached to the hub case 18 via fasteners 904. Rigidly attached to the ring 902 are blades 901. The design and application of blades used to enhance the flow of gases is well known within current engineering literature, see for example, *Mechanics and Thermodynamics of Propulsion*, Philip Hill and Carl Peterson (Addison-Wesley, 1965).

The design of these cascade type inlet vanes (or blades) for variable pitch marine propellers differs from those previously presented for fixed pitch propellers (for example, U.S. Pat. No. 4,212,586 by Aguiar or U.S. Pat. No. 4,875,829 by Van der Woude), in that the vanes (or blades) do not extend the full longitudinal length, L, of the propeller inner region 17. For the present application of the cascade type inlet vanes or blades 901, the maximum chord length, C, of the flow inlet vanes 901 is preferably less then the outer radius, R, of the hub 10. This shorter longitudinal length of the vanes (or blades) has the additional advantage of allowing more space for the variable pitch propeller mechanism components.

The number of internal flow vanes 901 needed to provide significant exhaust flow improvement is generally greater than the number of external, hydrodynamic blades 20. For example; a typical three bladed propeller shown in FIG. 1 can utilize 6 or more internal flow vanes 901. It should also be mentioned that these cascade type vanes can be designed to reduce inlet flow losses for the exhaust flow entering a rotating propeller, or can provide additional pumping means, wherein the absolute pressure of the exhaust flow exiting the vanes 901 is greater than the absolute pressure of the exhaust flow entering the vanes (or blades) 901.

These drawings and descriptions herein present preferred embodiments for a typical variable pitch propeller having three blades, however, the number of blades, need not be equal to three. The propeller components shown are preferably constructed of aluminum and/or other corrosion resistant materials, such as bronze, stainless steel or other corrosion resistant metal, or impact resistant polymers, such as polycarbonate, acetals, polybenzimidazole, polyether-ether ketone, or polyimide.

The patentable embodiments of this invention which are claimed are as follows:

1. In a variable pitch marine propeller comprising a hub case, connection means internally structurally connected to the hub case, to secure the hub case to a rotating drive shaft such that the propeller rotates with the drive shaft; a plurality of blades extending radially outward from the hub case, each blade having a shank extending into the hub case and being mounted to the hub case to allow pivotal movement about the blade axis; an arm attached to each shank, and located internally within the hub case; fluid flow connection means designed to connect the hub case to the exhaust system of a marine engine to cause exhaust gases to flow through the hub case; a counterweight mass, attached to the arm and offset from the shank pivot axis, such that inertial forces arising from propeller rotation acting on the center-of-gravity of the counterweight mass produce a torque about the blade shank axis; the improvement comprising means secured to the counterweight mass and so placed thereon to press against the hub case as a stop means, to limit the blade maximum pitch angle position.

2. In a variable pitch marine propeller comprising a hub case, connection means internally structurally connected to the hub case and designed to secure the hub case to a rotating drive shaft such that the propeller rotates with the drive shaft; a plurality of blades extending radially outward from the hub case, each blade having a shank extending into the hub case and being mounted to the hub case to allow pivotal movement about the blade axis; an arm attached to each shank, and located internally within the hub case; and fluid flow connection means designed to connect the hub case to the exhaust system of a marine engine to cause exhaust gases to flow through the hub case; the improvement comprising at least one secondary exhaust port opening through the hub case; valve means movably secured to the propeller so as to be movable between a first position closing off the secondary exhaust port and a second position opening the secondary exhaust port, and bias means connected between the valve means and the hub, and designed to tend to hold the valve means in the first position to close the secondary exhaust port when the propeller is at rest or at a low rotational speed, and counter-bias means responsive to the rotation of the propeller to cause the valve means to move in opposition to the bias means to the second position when the propeller is rotating at a speed above a predetermined minimum.

3. The variable pitch propeller of claim 2 wherein the bias means comprises a spring.

4. The variable pitch propeller of claim 2 wherein the counter-bias means comprises inertial means which develops a force effect tending to move the secondary exhaust port valve means to the open position based upon centrifugal force effects.

5. The variable pitch propeller of claim 2 wherein the valve means comprises a cylindrical sleeve slidably connected adjacent the internal surface of the hub case and forward of the blades, and wherein exhaust flow ports are formed through the sleeve and through the outer hub case.

6. In a variable pitch marine propeller comprising a hub case; drive securing means structurally connected to, and located centrally, internally of, the hub case, to secure the hub case to a rotating drive shaft such that the propeller rotates with the drive shaft; a flow channel defined between the hub case and the drive securing means; a plurality of blades extending radially outward from the hub case, each blade having a shank extending into and through the flow channel within the hub case and being mounted to the hub case to allow pivotal movement about the blade axis; an arm attached to each shank, and located internally within the hub case; and fluid flow connection means to connect the hub case to an exhaust system of a marine engine to permit exhaust gases to flow through the hub case; the improvement wherein the blade shank is noncircular in cross section such that the cross-sectional area of the shank portion, extending within the flow channel, which is perpendicular to the direction of exhaust gas flow, is less than the cross-sectional area, of the shank portion extending within the flow channel, which is parallel to such exhaust gas flow, and further comprising a counterweight mass, attached to the arm and offset from the shank pivot axis, such that inertial forces arising from propeller rotation acting on the center-of-gravity of the counterweight mass produce a torque about the blade shank axis; the further improvement wherein the connecting region between the blade arm and the counterweight mass has a narrower radial width than that of the counterweight mass along an axis parallel to the drive shaft axis and parallel to the flow of exhaust gases.

7. In a variable pitch marine propeller comprising a hub case; drive securing means structurally connected to, and located centrally, internally of, the hub case, to secure the hub case to a rotating drive shaft such that the propeller rotates with the drive shaft; a flow channel defined between the hub case and the drive securing means; a plurality of blades extending radially outward from the hub case, each blade having a shank extending into and through the flow channel within the hub case and being mounted to the hub case to allow pivotal movement about the blade axis; an arm attached to each shank, and located internally within the hub case; and fluid flow connection means to connect the hub case to an exhaust system of a marine engine to permit exhaust gases to flow through the hub case; the improvement wherein the blade shank is noncircular in cross section such that the cross-sectional area of the shank portion, extending within the flow channel, which is perpendicular to the direction of exhaust gas flow, is less than the cross-sectional area, of the shank portion extending within the flow channel, which is parallel to such exhaust gas flow, and further comprising a counterweight mass, attached to the arm and offset from the shank pivot axis, such that inertial forces arising from propeller rotation acting on the center-of-gravity of the counterweight mass produce a torque about the blade shank axis; the further improvement which comprises internal surfaces formed within the blade arm adjacent the shank and defining at least one channel to permit exhaust gases to flow through the arm and counterweight assembly.

* * * * *